United States Patent [19]

Brown et al.

[11] Patent Number: 4,503,989

[45] Date of Patent: Mar. 12, 1985

[54] CAN END WITH RETAINED TEAR STRIP

[75] Inventors: Omar L. Brown, Kettering; Don B. Peters; James R. Schubert, both of Dayton, all of Ohio

[73] Assignee: Ermal C. Fraze, Dayton, Ohio

[21] Appl. No.: 575,904

[22] Filed: Feb. 1, 1984

[51] Int. Cl.[3] ..... B65D 17/34

[52] U.S. Cl. ..... 220/269

[58] Field of Search ..... 220/269-273

[56] References Cited

U.S. PATENT DOCUMENTS

| | | | |
|---|---|---|---|
| 3,900,128 | 8/1975 | Brown | 220/269 |
| 4,399,925 | 8/1983 | Fundom | 220/269 |
| 4,416,389 | 11/1983 | Wilkinson et al. | 220/269 |
| 4,417,668 | 11/1983 | Stolle | 220/269 |

*Primary Examiner*—George T. Hall

*Attorney, Agent, or Firm*—Beehler, Pavitt, Siegemund, Jagger & Martella

[57] ABSTRACT

An end structure for an easy opening container includes a rivet formed in a pour panel defined by a non-continuous scoreline. Upon rupture of the scoreline by a tab, which is affixed to the panel by the rivet, both the tab and pour panel are retained on the end wall. The scoreline may include a region of minimal residual in the region which is initially popped and regions of increased residual along the length of the scoreline in the direction of the fracture. The scoreline forward and adjacent to the rivet is of a configuration which includes changes of direction rather than being a smooth continuous curve and cooperates with the stepped scoreline to reduce blow-off. Also provided is a coined region radially outward of the rivet and the panel radius to create slack such that when the container is pressurized, the lifting end of the tab is forced downwardly. Associated with the coined region is a localized coined panel radius which controls the location of the possible end buckle to reduce scoreline fracture due to buckle. Provision is made to reduce laceration and an improved ring-pull tab acting as a Class 2 lever is disclosed.

19 Claims, 13 Drawing Figures

FIG. 3
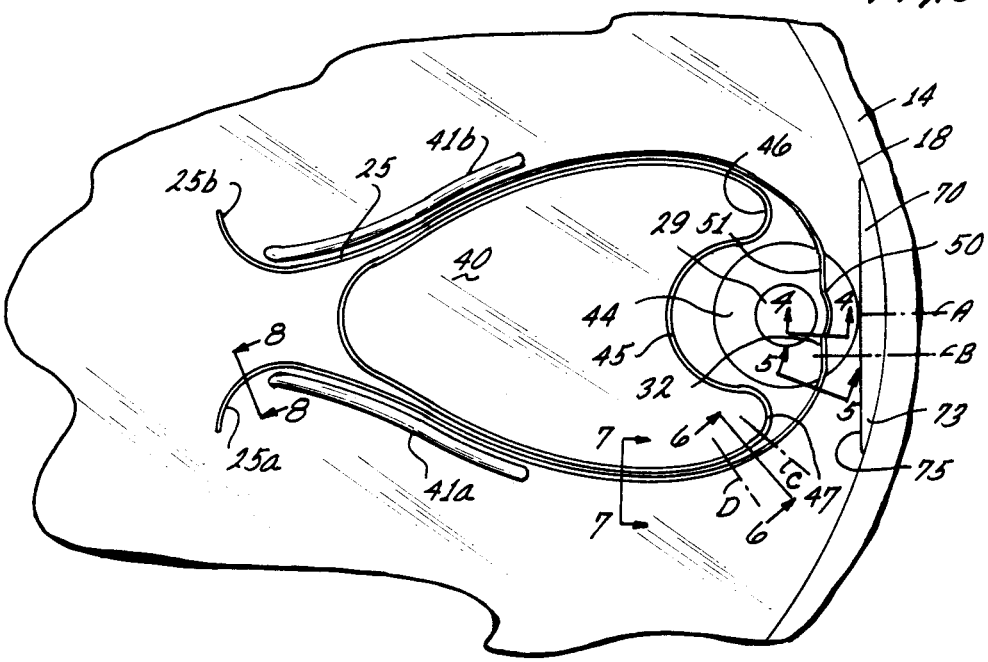
FIG. 4
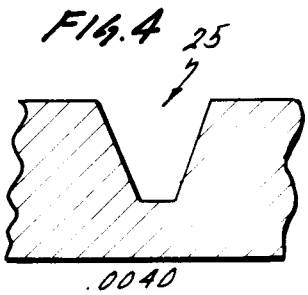
FIG. 5
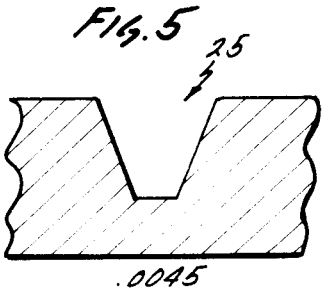
FIG. 6
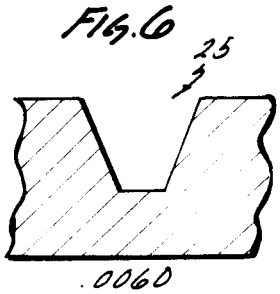
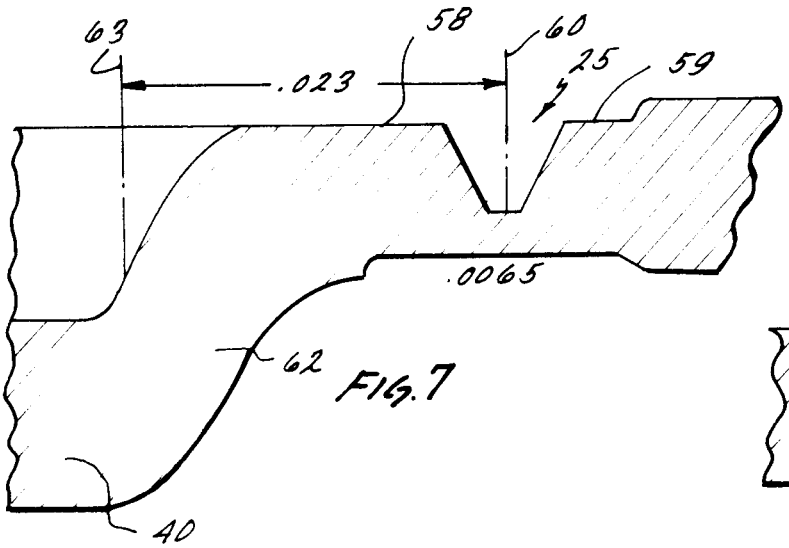
FIG. 7
FIG. 8
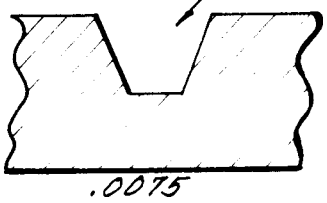

CAN END WITH RETAINED TEAR STRIP

BACKGROUND OF THE INVENTION

This invention relates to easy-opening can ends and more particularly to an improved end structure for a container in which both the tear strip which defines the pour opening and the tab element used to rupture the scoreline forming the tear strip are retained on the end wall of the can end.

The ready acceptance of easy-opening cans has resulted in extended use of this type of container for a substantial number of can products, especially beverages such as beer, soft drinks and the like, and other products. Traditionally this type of container is in the form of an aluminum or other alloy can body which includes an end wall which is characterized by a lever or tab which is permanently joined to a tear strip, the latter being separable from the can top to provide a pouring spout, in the case of beverages, or to provide for removal of essentially the entire end wall of the container. In the form heretofore used, the end wall is ruptured along a continuous scoreline, and the pull tab, usually a ring tab, and tear strip are removed and normally discarded.

More recently, ecological concerns have resulted in container and end wall structures in which the tab and the tear strip remain attached to the container. Typical such structures are those described in U.S. Pat. Nos. 4,015,744; 4,024,981, and 4,030,631, all assigned to the present assignee. While the containers and easy-opening end structures and components thereof, as described in the above-identified patents, have been used in a significant number commercially, some users have objected because of the opening action in which the panel which forms the pour opening is forced into the can. While steps are normally taken during the packaging and shipment of containers of the type described to prevent accumulation of foreign matter on the surface of the container end wall, nonetheless, there have been some objections to easy-opening end structures in which the panel is forced into the container during the opening sequence.

A further problem which has arisen relates to some of the marketing approaches utilized in soft drink beverage marketing and other similar products. For example, various types of beverages are marketed in plastic or glass containers, the plastic or glass containers including a cap affixed to the container and which must be removed to gain access to the contents. In various promotional type marketing programs, the manufacturers have placed on the non-public side of the cap certain coded information usable in awarding prizes of various types from the manufacturer. Since the marking is on the non-public side, that is, the side of the cap facing the interior of the container and thus not visible until the cap is removed, the use of this type of marketing device has generally been limited to beverage container packages in which the consumer cannot inspect the non-public side of the closure element. As a matter of convenience, in easy-opening containers of the type identified in the preceeding patents, the consumer generally cannot see the non-public side of the pour panel which forms the pour opening since that panel is depressed into the container and it is inconvenient to remove the entire end wall of the container in order to determine what may be printed on the non-public side of the container end wall.

There are, in the prior art, easy-opening can ends which utilize a retained tear strip whose non-public side is exposed during an opening operation, see, for example, U.S. Pat. No. 3,900,128, also assigned to the same assignee as this application.

Another problem which sometimes exists with a retained tear strip end structure in which the tear strip is located above the end wall after rupture of the scoreline is "blow-off". It is believed that the sudden release of pressure during an opening sequence may cause the pour panel to be separated from the end wall.

In general, the approaches taken to prevent "blow-off" involve the provision of sufficient scoreline integrity to prevent the scoreline from being ruptured completely and instantaneously as a result of internal pressure of the container. However, the provision of scoreline integrity may also result in the need for increased force in order to achieve the initial pop, or initial fracture of the scoreline during an opening sequence. Generally, scoreline integrity may be achieved by providing a residual, which is higher than that normally used, with the result that it requires much more force to achieve an initial pop than would be the case with the same structure using a scoreline of a lesser residual. Also, when the residual is increased, in order to prevent "blow-off", it is generally necessary to use a tab of stronger or thicker stock material in order to withstand the forces in bending to which the longitudinal tab lever is subjected during the initial pop and tearing or severance of the scoreline.

The structure described in U.S. Pat. No. 3,900,128 is satisfactory as an end wall structure and does solve some of the problems above described. However, the ends thereof did not stack as well as some of the other goods heretofore used. More particularly, in the automated equipment generally used in the beverage field, the end walls are advanced to an appropriate station where they are double-seamed on the can end and the transport of the can end structures from one point to the other generally requires that they "stack" properly in order to be moved from one point to another by automated equipment.

Since the operation of can ends having a retained tear strip results in the tear strip being above the end wall of the container and folded back during an opening sequence, provisions have also been made to reduce the sharpness of the metal along the edges of the tear strip in order to reduce laceration.

Still another problem, as discussed in U.S. Pat. No. 3,900,128 is that of raising the end of the tab above the end wall and possibly above the chime as a result of doming.

Another problem which has arisen, especially with beer and beverage containers is buckling of the end wall. In part, this problem has been exacerabated by the tendency to go to thinner end wall stock for reasons of economy. As understood, if the internal pressure within the packed container increases an appreciable amount, as may occur during shipment or storage in hot climates or seasons, the end wall literally buckles such that a portion of the end wall is deformed upwardly above the top of the end flange. In those instances in which the rivet is closer to the chuck wall than to the center of the end, the buckling appears to be generated along the region between the chuck wall and the rivet.

Prior art attempts to reduce buckling have involved coining what is called the panel radius, i.e. that region of the end wall which is effectively the outer radial edge of the center panel of the end. The coined band extends 360 degrees around the center panel and may be formed on the public or non-public side of the end. This coined panel radius has been effective in reducing buckling by uniformly strengthening the end wall.

If, however, the structure of the end is non-symmetrical, i.e. the rivet is not centered in the end panel or there are formations in the end panel which significantly effect end symmetry, the 360 degree coined panel radius is not fully effective to prevent buckling in an unwanted region. For example, if there is a finger well under the lifting end of the tab, buckling may take place in the region of the finger well. So too, if the scoreline is adjacent to the radial edge of the panel radius, buckling may take place in that region of the end wall. More specifically, if both the rivet and the scoreline are off center and adjacent to the radial edge of the panel, it has been observed that in those instances in which buckling takes place, it may be sufficiently severe to cause rupture of the scoreline. Thus, while buckling is a problem, it is even a greater problem when it occurs in a region of the end where it affects operation or integrity of the end structure.

Accordingly, it is desirable to provide an easy-opening end structure for use as a closure member in a can such that there is a retained strip whose non-public side is exposed on rupture of the principal scoreline, and preferably a structure which reduces lacerations. It is also advantageous to provide an easy-opening end in which all components of the end structure remain with the end structure, thus eliminating loose pieces which may become litter and thus solving, to some extent, concerns related to the ecology and the litter which may accumulate from indiscriminantly-disposed-of tear strips. It is also advantageous to provide an ecology-type of easy-opening end structure in which the tab is in the form of a pull-ring of the type used for many years in easy-opening end structures, and whose basic opening sequence is similar to that of the pull-ring type of easy-opening ends used for many years but which involved separating both the tab and the tear strip from the end structure. Further, it is desirable to provide a structure of the type described in which the tendency of the lifting end of the tab to be displaced upwardly as a result of doming of the end wall is reduced.

SUMMARY OF THE INVENTION

While the foregoing desirable objectives of this invention are achieved by the present invention, the principal objective is to control buckling such that if it takes place, it occurs in a region of the end which does not destroy the integrity of the end, as by rupture of the scoreline, nor does it interfere with the functional operation of the end.

Accordingly, the above-identified objectives and others are achieved in accordance with the present invention through an improved container end structure, principally for use with cans in which the tab is retained on the end wall and wherein the pour opening is formed by a strip which is pulled upwardly such that the non-public side of the strip is exposed as a result of the opening sequence.

"Blow-off" of the panel is substantially prevented through the use of a unique scoreline structure in which there is a portion of the scoreline which has the least residual (the unscored metal beneath the scored section of the scoreline) that portion being located beneath the portion of the tab which initially functions to create the initial fracture, or initial "pop" of the scoreline. Further, the scoreline is of a configuration which tends to inhibit lateral tearing of the scoreline in a rapid manner, i.e., the scoreline effectively changes direction preferably in the region of the least residual. By use of a region of reduced residual cross section, the initial "pop" is vastly facilitated. By use of a scoreline geometry in which there is a change in the direction of the propogation of scoreline fracture, rapid lateral fracture of the scoreline from the region of initial "pop" is inhibited.

Located adjacent the region of reduced cross section residual, the scoreline includes zones of gradually increasing cross-sectional residual, again assisting in venting the strip which is initially formed after the initial "pop" from being suddenly and immediately blown loose from the remaining portion of the end structure and which is prevented from becoming an air-borne missile, as is frequently the case where "blow-off" is encountered.

In the form of scoreline employed in connection with the end structure of the present invention, the scoreline is preferably discontinuous and terminates in two outwardly flared legs, the residual region of the flared legs constituting the portion of the scoreline having the highest residual.

As is known, the difficult part of an opening sequence is the so-called initial "pop" which represents the initial rupture of the scoreline. Once the scoreline has been ruptured initially, the remaining rupture of the scoreline is a comparatively uncomplicated operation. Thus, in accordance with this invention, the residual area of the scoreline gradually increases from the region which is initially popped until the region of the reversing legs in order to reduce the possibility of "blow-off". Nonetheless, even though the residual gradually increases in cross section, the nature of the opening sequence is such that it remains relatively uncomplicated in the sense that rupture of the remaining portion of the scoreline is retained on the end wall. Due to the presence of a dished portion in the panel, as a result of severance of the scoreline to form a retained strip, the edges of the retained strip appear to be relatively dull and thus reduce the possibility of laceration. Even the edge formed on the pour opening appears relatively dull, and likewise tends to inhibit laceration.

Unlike some of the container end structures of the prior art referred to, the end structure of the present invention also possesses the ability to "stack" well, thus reducing the objections of some of the prior art devices.

Another practical advantage of the end of the present invention is that it is of a retained tab variety, thus permitting placement of printed information on the non-public side of the container end wall, which printed information is concealed from the public until such time as the container end is opened by fracture of the scoreline to form a pour opening, as a result of which the non-public side of the end structure in the region of the pour opening now becomes visible and any information printed thereon may be easily read.

Another practical advantage of the end structure of the present invention is the fact that the opening sequence is comparable to the opening sequence heretofore used in end structures in which the tab is in the form of a "ring-pull" tab, as opposed to tabs used with the ecology end containers previously referred to in the above-identified patents.

A feature of this invention is the use of a coined section in the end wall forward of the rivet and preferably extending circumferentially thereof to provide what might be called loose material thereby permitting the coined region to raise somewhat. Thus, when the end is seamed to a can body, and the can is under internal pressure, the upward movement of the coined area tends to lift the front end of the tab to pivot the lifting end of the tab downwardly.

An important feature of the present invention is the provision of a coined region whose location, relative to other components in the end structure, is such that if buckle does occur, it takes place in a controlled area of the end. More specifically, the panel radius of the end is coined in a defined location, such as adjacent the scoreline region with the result that if buckle takes place, it occurs remote from the coined panel radius.

By way of comparison, if there are two ends of identical structure, with a scoreline and rivet reasonably close to the chuck wall, and one is coined 360° around the panel radius, or full coined so-called, and the other is panel radius coined only in the region of the rivet and scoreline, buckle tests of the ends demonstrate that with the present invention buckling takes place in the region of the end opposite the scoreline and partially coined panel radius. In comparison, the same end with a full coined panel radius exhibits buckle at the scoreline and rivet region. In this latter case, if the buckle is sufficient, the scoreline may be ruptured, an event which this invention is intended to prevent.

It will be apparent from the following detailed description that a much improved retained tab and retained tear strip end structure is disclosed, and the further features and advantages thereof may be best understood by reference to the following description taken in connection with the accompanying drawings.

BRIEF DESCRIPTION OF THE DRAWINGS

FIG. 3 is a fragmentary view of the container end structure illustrated in FIG. 1 with the tab removed, and illustrating the structure of the end wall in the region thereof around the pour panel, in accordance with the present invention;

FIG. 4 is a view in section taken along the line 4—4 of FIG. 3;

FIG. 5 is a view in section taken along the line 5—5 of FIG. 3;

FIG. 6 is a view in section taken along the line 6—6 of FIG. 3;

FIG. 7 is a sectional view taken along the line 7—7 of FIG. 3;

FIG. 8 is a view in section taken along the line 8—8 of FIG. 3;

DETAILED DESCRIPTION OF THE INVENTION

Figure 1:
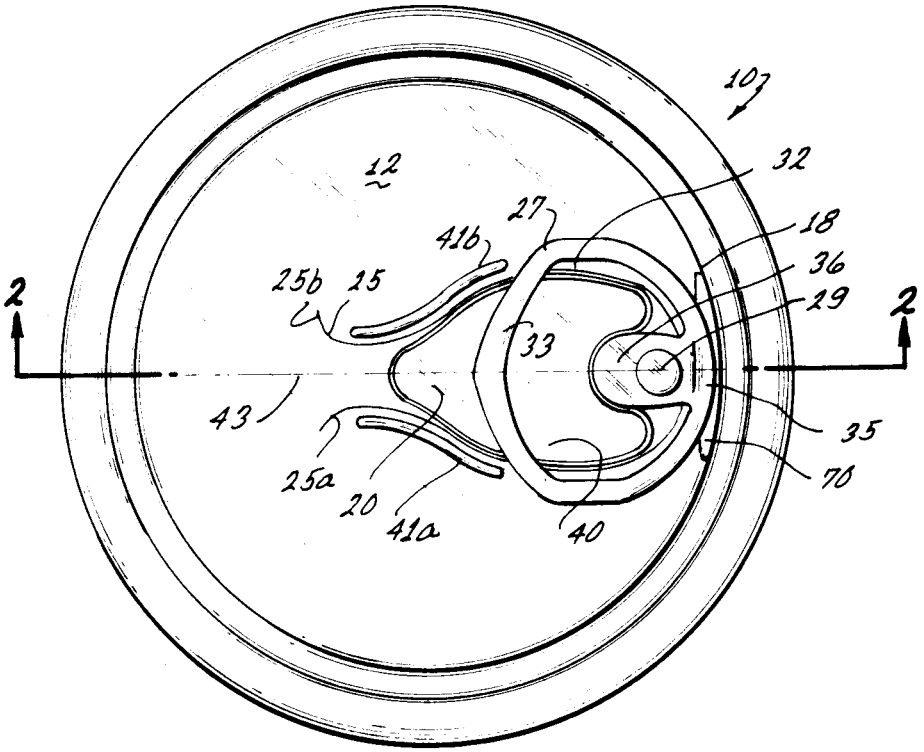
FIG. 1 is a plan view of a retained tab and tear strip container end structure in accordance with the present invention.
Figure 2:
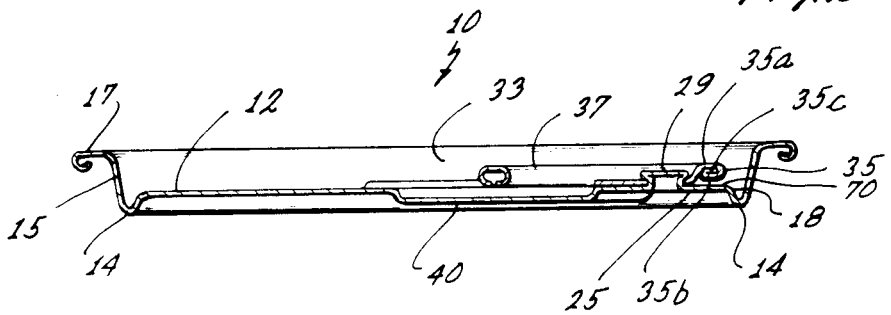
FIG. 2 is a view, partly in section and partly in elevation, taken along the line 2—2 of FIG. 1.

Referring to the drawings, FIGS. 1 and 2 illustrate a preferred form of the present invention, and show a container end wall 10 which may be fabricated of aluminum alloy or other metal, as is well known in the art. The end wall structure 10 includes a center panel section 12 which is generally circular in the form illustrated and which may be bounded by a groove 14 associated with a chuck wall 15 which extends vertically above the groove and which is flared outwardly slightly, the chuck wall terminating in a flange 17 which is used to attach the end structure 10 to a can body as by double seaming and the like. The end wall may also be of the type which does not have a groove and is known as a flat panel end. In either case, the end includes what is referred to as a panel radius 18.

The flange 17 is spaced vertically above the center panel 12, as illustrated in FIG. 2, the center panel including a pour panel 20 formed by a scoreline 25 which is preferably non-continuous, as illustrated in the drawing. Attached to the end wall, and more specifically to the pour panel is a tab element 27, the tab being attached by an integral rivet 29, as illustrated. In the form illustrated, the tab 27 is of the ecology ring-pull type and includes a relatively large opening designated 32, and a rear end 33 which functions as a lifting end. The rear end of the tab may, if desired, be as shown in U.S. Pat. No. 3,850,124 assigned to the same assignee. The tab also includes a nose portion 35 and an ear section 36 to the rear of the nose portion, the ear of the tab being provided with an aperture through which the rivet 29 extends to secure the tab on the end wall and in the proper location with respect to the scoreline 25.

As illustrated in FIG. 2, the tab rests on the portion of the end 10 which is above the center panel 12 and below the upper surface of the flange 17, and as also illustrated, there is sufficient space above the upper surface 37 of the tab such that another end structure of essentially the same type and dimensions may easily nest, i.e., stack, with respect to the end. As illustrated, the nose portion 35 of the tab is formed of multiple folds of sheet material, the nose being formed by an upper layer 35*a*, a lower layer 35*b*, and an intermediate layer 35*c*, all of which are integral. The tab structure itself is preferably formed initially from flat sheet stock material by processing in a progressive die set, which forms the tab to the configuration shown. As illustrated, the tab includes a ring-pull section formed of multiple layers, at least two, of sheet material in order to provide strength. The tab 27 functions as a longitudinally rigid lever in an opening sequence of the container end structure.

As illustrated in FIGS. 1 and 2, the scoreline 25 is non-continuous and terminates in reversing legs 25*a* and 25*b*, while the portion of the pour panel 20 forward of the reversing legs and to the rear of the rivet ear 36 includes a depressed panel section 40, the depressed panel 40 underlying the tab 27, and the tab being dimensioned transversely such that it is slightly larger than the pour panel depression 40, as illustrated. The end wall 10 also includes raised projections 41*a* and 41*b* which serve to provide some longitudinal stiffness in the end structure along the region of the scoreline to the rear of the tab and forward of the reversing legs 25*a* and 25*b* in order to facilitate continued severance of the sheet metal during an opening sequence.

Referring now to FIG. 3, the end structure of FIG. 1 is illustrated in enlarged view, with the tab removed, in order to illustrate more clearly the scoreline configuration as well as the configuration of the depressed panel section 40 and the relationship thereof to the location of the rivet 29. Between the reversing legs 25*a* and 25*b* is a section 43 of the center panel which forms a hinge upon rupture of the scoreline such that the pour panel 20 remains attached to the center panel 12. Surrounding the rivet 29 is a rivet well 44 spaced radially inwardly from the groove 14, with a portion of the scoreline being located in the rivet well and to the front of the rivet and between the rivet and the groove 14.

As illustrated in FIG. 3, the depressed panel section 40 of the pour panel includes a curved region 45 which follows the generally circular contour of the rivet well 44, but which is spaced therefrom. The portion of the pour panel between the curved region 45 and the area surrounding the rivet well is at essentially the same level as the center panel 12. As shown, the depressed panel section 40 also includes spaced legs 46 and 47 closely adjacent to the opposed sections of the scoreline 25.

To reduce "blow-off", the scoreline 25 is fabricated such that the residual of the scoreline varies progressively from the region of the scoreline which is initially popped to the reversing legs 25*a* and 25*b*. By increasing the residual from a minimum value to a maximum value, the initial rupture of the scoreline reduces the potential for the pour panel being blown free of the center panel and becoming an airborne missile. Thus, for example, this may be achieved by the use of a scoreline which has a residual of 0.0040 of an inch in the region adjacent to the rivet. For example, as illustrated in FIG. 3, the region of the scoreline with the least residual is that between lines A and B. In the region of the scoreline between lines B and C, the residual is increased slightly and may, for example, be 0.0045 of an inch. A comparison of residuals appears in FIGS. 4 and 5, in which FIG. 2 represents, schematically, the residual between lines A and B, while FIG. 5 represents the residual between lines B and C. The portion of the scoreline between lines C and D includes a still higher residual, as is illustrated, for example, in FIG. 6, while the residual of the remaining portion of the scoreline is still greater, as illustrated, for example, in FIGS. 7 and 8. Thus, the residual illustrated in FIG. 6 may be 0.0060 of an inch, while that illustrated in FIG. 7 may be 0.0065 and that illustrated in FIG. 8 may be 0.0075 of an inch. It is to be understood that scoreline residuals are essentially in the same relationship on the other half of the scoreline, i.e., the region from the reversing leg 25*b* to the portion of the scoreline forward of the rivet is essentially of the same dimension and residual as the corresponding region from leg 25*a* to the rivet. The actual cross section of the residual may be other than the representative values given or shown in FIGS. 4–8. In any event, however, the scoreline, in accordance with the present invention includes a residual which is a minimum at the location of initial pop and which gradually and progressively increases in the direction of scoreline severance along the length of the scoreline. It is also preferable to have the residuals in the corresponding regions of comparable values so as to achieve a uniform rupturing of the scoreline along its length. The transition from one cross-sectional residual to the next may be either gradual or sharply defined depending upon the scoring tools used. Also, the number of regions of change in residual may be as described for uniform ease of opening, or more or less zones may be used.

Cooperating with the "stepped" scoreline as described, the scoreline configurations in the region where the initial pop takes place is of a configuration which tends to reduce rapid lateral propogation of scoreline fracture. Referring to FIG. 3, the scoreline 25 includes a portion 50 radially outwardly of the rivet 29 which is arcuate, as shown, and two adjacent sections 51 and 52 which use non-arcuate relative to section 50 and the portion of the scoreline laterally of sections 51 and 52. Thus, the portion of the scoreline from 50 and laterally through regions 51 and 52 effectively changes direction in that the region of the scoreline is not a continuous curve. It will be apparent that other configurations may be used to provide a non-continuous symmetry. In operation, after the initial pop of the scoreline in the region immediately forward of the rivet, the geometry of the scoreline and the progressively increasing residual of the scoreline on each side of the rivet provent the pour panel from being blown loose of the center panel while permitting continuous rupture of the scoreline by pulling on the tab 27.

Referring to FIGS. 1 and 2, the initial rupture of the scoreline is effected by lifting on the end 33 of the tab, while the nose 35 of the tab bears down against that portion of the center panel immediately beneath the nose. It should be noted that the portion of the scoreline beneath the opening of the tab is located adjacent the intersection of the vertical wall of the rivet and the horizontal wall of the center panel as shown in FIG. 3, such that the nose or opening end of the tab is spaced radially outwardly of the scoreline. In other words, the scoreline is located in front of the rivet, but to the rear of the nose of the tab. Thus, in an opening sequence, the nose of the tab bears against the underlying portion of the center panel and the ear section 36 of the tab tends to lift the rivet 29 as the lifting end 33 of the tab is lifted and the tab thus functions as a Class 2 lever and must accordingly possess sufficient longitudinal strength. There are advantages in an initial opening sequence in which the tab functions as a Class 2 lever, since lifting of the rivet places the portion of the scoreline forward of the rivet in a shear condition in which the internal pressure of the container assists, since the shear condition is created by lifting on the rivet while the nose of the tab maintains the portion of the end wall beneath the tab in a relatively static position. Once initial pop has been achieved, the user may insert a finger through the opening 32 in the tab and pull the tab and the attached pour panel 20 rearwardly to the reversing curves 25*a* and 25*b* which prevent further rupture of the metal and the pour panel remains attached to the end wall through the hinge region 43. The provision of differing scoreline residuals and the geometry described reduces the potential of the pour panel from being blown free of the end wall, however, the continued rupture of the scoreline is a relatively smooth operation subsequent to the initial pop.

In the ruptured, full opened condition of the end, the tab is positioned to the left as seen in FIG. 1, with the pour panel being folded in the area generally represented by the reversing curves 25*a* and 25*b* such that the side of the pour panel, which initially faced the container contents, is now facing upwardly, that is, towards the public.

One aspect of the present invention is the relationship between the scoreline and the depressed panel such that laceration of the finger by the exposed edge of the fractured scoreline is reduced. Thus, for example, referring to FIG. 7, it will be seen that the scoreline 25 includes adjacent coined sections 58 and 59. These adjacent coined sections 58 and 59 are preferably adjacent the scoreline throughout its entire extent. Between the center of the scoreline 60 and the depressed panel section 40 is a transitional wall section 62. By maintaining a small dimension between the center of the scoreline and the break in the transition from the depressed panel section to the transitional wall section 62, as indicated at 63, it has been determined that laceration is substantially reduced. What formerly was a depressed panel before opening the container now appears as a raised panel after the opening sequence such that the free edge of the scoreline adjacent coined area 58 is positioned quite close to the end wall and does not appear as an extending sharp edge, due in part to the effect from the depression 40. Further, the depressed panel 40 now appears as an elevated raised section, thereby reducing laceration of the free edge which bounds the periphery of the formed and retained pour panel 20, the free edge now being located between the end wall and the portion of the pour panel which is not elevated with respect to the remaining edge which is closely adjacent thereto.

As mentioned previously, one of the features of the present invention is the improvement in the end of the type described of the tendency of the lifting end of the tab to move upwardly as a result of internal pressure within a container of which the end of this invention forms the end wall. As described in U.S. Pat. No. 3,900,128, when exposed to internal pressure, the center panel section 12 tends to dome. Since the tab is located adjacent to the chuck wall 15, with the free, or lifting, end of the tab extending radially inwardly of the chuck wall, the geometry is such that doming of the panel section tends to cause the lifting end of the tab to raise up relative to the top of the chuck wall, and in some cases the free, or lifting, end of the tab may even raise sufficiently such that the end is above the top of the chuck wall. The result is that the lifting end of the tab may be caught or snagged, causing rupture of the scoreline.

In accordance with this invention, a relatively simple but effective means is provided to reduce substantially the tendency of the lifting end of the tab to be raised as the result of pressure within the container. Thus, referring to FIGS. 1 and 3, a coined region 70 is provided in the panel section 12, formed of the rivet 29 and in that region of the panel section between the rivet well 44 and the panel radius 18. As shown in FIG. 3, the coined region 70 is positioned in that region of the panel section beneath the opening end or nose portion 35 of the tab 27 and extends circumferentially along the panel radius on each side of the rivet, as shown.

The purpose of the coining is to provide loose material in a selected and predetermined region of the panel section such that as the panel section is exposed to internal pressure, the region of the panel section represented by the coined region will move upwardly causing the lifting end of the tab to move downwardly. The result is that the lifting end of the tab does not move as far upwardly as it would move if the coined region were not present.

The coined region may be formed in the end shell during formation of the scoreline or by a separate operation, if desired.

In the form shown, the coined region 70 is located in a peripheral portion of the center panel, as described, and includes a curved outer segment 73 (FIG. 3) which follows the curvature of the radial edge of the center panel, i.e., the panel radius. The other segment 75, which defines the shape of the coined region, is in chordal relation to segment 73 with the maximum radial dimension of the coined region being radially outwardly of the rivet, and the radial dimension gradually decreasing on each side of the rivet. It will be appreciated that other shapes may be used, however, a sufficient region of coined metal should be provided to permit a localized section beneath the opening end of the tab to move upwardly, in response to pressure, to assure that the lifting end of the tab remains closely adjacent to the end wall.

Figure 9:
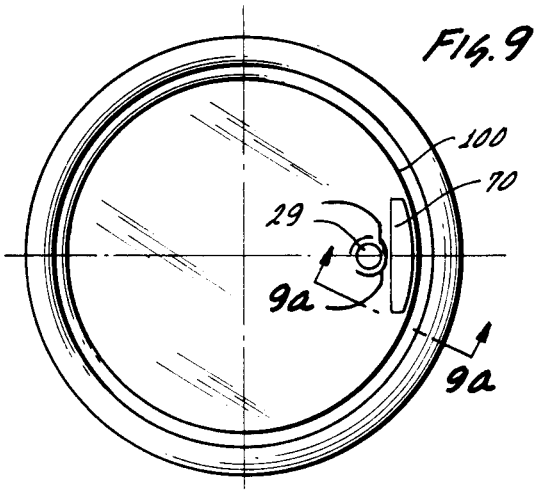
FIG. 9 is a diagrammatic view showing the region of the end in which the panel radius is coined on the outside or public side of the end in accordance with the present invention.
Figure 10:
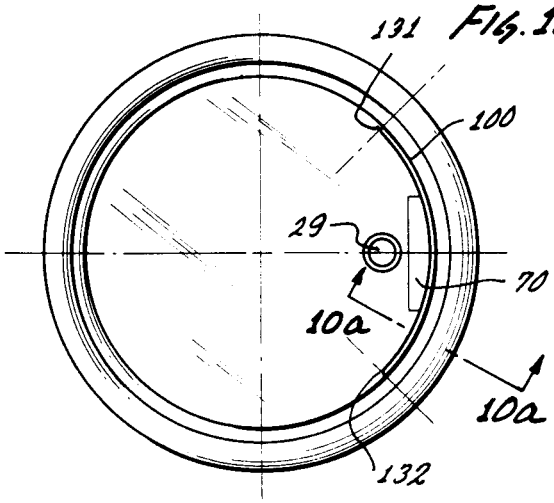
FIG. 10 is a view similar to FIG. 9 but illustrating another coined panel radius arrangement of the present invention.
Figure 11:
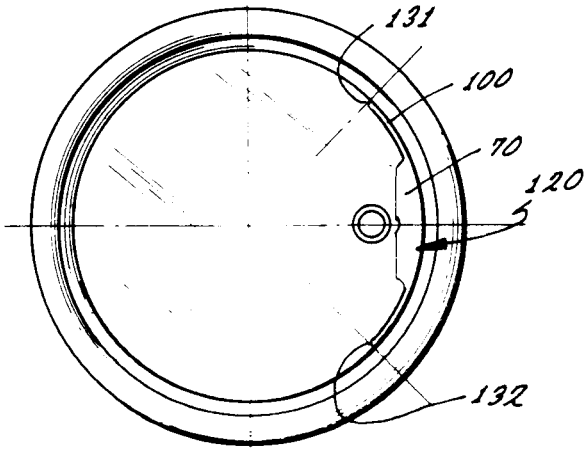
FIG. 11 is a view similar to FIG. 9 diagrammatically and illustrating an end structure in which both the coined panel radius and coined region are simulataneously formed in according with the present invention.

The improved end structure of this invention also includes structure to control buckling such that if buckling takes place, it occurs in a controlled area of the end. Referring to FIGS. 9 to 11, a defined portion of the panel radius is coined to strengthen a localized region of the end wall. Again the purpose is to reduce buckling, but if buckling does occur, by the present invention the end will buckle remote from the scoreline so that the buckling will not burst the scoreline.

As shown in FIG. 9, approximately 90° of the panel radius is coined as at 100, i.e. about 45° on each side of the center of the rivet 29. The coined region 70, which in this view is slightly different from the configuration shown in FIG. 3, is located slightly radially inwardly panel radius, radially of the coined region 70 is coined and forms part of the panel radius coined zone.

Figure 9A:
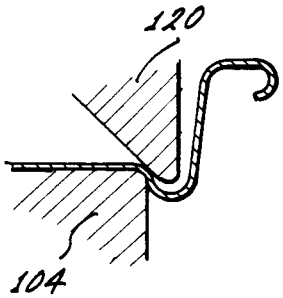
FIG. 9*a* is a diagrammatic view in section illustrating one type of tooling which may be used to form the coined panel radius region as shown in FIG. 9.

In belt type equipment, the panel radius coin may be before or after the scoreline is formed and may be provided by tooling diagrammaticly illustrated in FIG. 9*a*. The tooling includes a coin die 102 and anvil 104, the anvil being radiused to fit the contour of the panel radius on the underside, or non-public side of the end. The coin die 102 is angled at 45°, as shown, such that the face 106 of the die contacts the panel radius on the public side as the die is advanced relative to the anvil 104.

The die and anvil are configured to extend arcuately for 90° around the periphery of the panel so as to coin the panel radius on the public side and in the region radially of the rivet and scoreline area. This form of tooling may be used with a belt press and the panel radius may be coined before or after the scoreline is formed in the end.

Figure 10A:
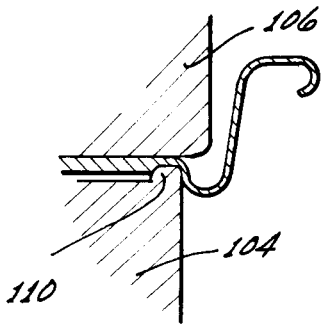
FIG. 10*a* is a view similar to FIG. 9*a* illustrating the tooling used to form the coined panel radius of FIG. 10.

The panel radius may be coined on the inside surface or non-public side of the end, as shown in FIG. 10, where the same reference numerals have been used, where applicable. Again, the coin extends about 90° of the periphery of the panel radius, as shown, and is radially outwardly of the rivet 29. The coin on the non-public side of the panel radius may be used where the end forming equipment is a rotary type press. FIG. 10*a* illustrates one form of tooling, which includes an anvil 106 and a die 109, the latter having a coin face which may for example be 0.040 of an inch across. Again, the coin of the panel radius may be formed before or after the formation of the scoreline.

It is also possible to combine the coined region 70 and the panel radius coin 100 into one coined formation generally indicated as 120. In this form, the combined coined formation is shown on the top or public side of the end. In those instances in which the coined regions are combined, it is preferred to form the combined coin 120 while the scoreline is being formed.

In operation, the panel radius coin operates to strengthen the portion of the end wall in the region of the scoreline and may thus extend arcuately a sufficient distance such that the ends 131 and 132 of the panel radius coin extend arcurately beyond the scoreline. Since only a segment of the panel radius is coined, the corresponding segment of the end wall is strengthened. Thus, if the pressure within the container increases sufficiently to cause buckling, the buckle will appear in the region of the end other than in the region of the scoreline and thus the scoreline is protected from possible fracture due to substantial metal deformation. This is in contrast to the prior art panel radius coining which extended 360 degrees around the end to strengthen the entire periphery of the end. Even though strengthened, if the internal pressure was high enough to cause buckling, the scoreline was sometimes fractured. This feature of the present invention does not eliminate buckling, but effectively directs it to a region of the end structure where it causes little, if any, problems. Accordingly, local and defined panel radius coining may be used in the end structure to protect a selected, defined portion of the end from buckling or causing damage to that portion of the end due to buckling.

From the above, it will be seen that a much improved ecology type end structure is provided which offers several advantages over the prior art structures. Since the opening end of the tab overlies a portion of the depression, there is a natural finger well formed which assists in lifting the end 33 of the tab. Further, from a consumer standpoint, the tab structure is a ring-type structure whose action is somewhat similar to what the public has been accustomed to using prior to the advent of ecology type easy opening containers in which the tab did not include an opening through which the finger was intended to be placed. Nonetheless, the structure of the present invention results in retention of the tab and pour panel on the end structure, while reducing the potential for "blow-off".

Another aspect of the improvement represented by this invention is that the lifting end of the tab remains down when the container is pressurized, while the ends also stack well as compared to some of the prior art structures. Also, since the pour panel is relatively large, printed material may be placed on the non-public side and, after rupture of the scoreline, is now viewable on the public side since the ruptured pour panel is not forced into the pour opening. Also, the scoreline is protected from rupture due to buckling of the end wall.

Various modifications may be made, as will be apparent from the above, without departing from the invention as set forth in the appended claims.

What is claimed is:

1. An end structure for an easy-opening container comprising:

a center panel having a panel radius extending 360° around the periphery thereof;

a scoreline in said center panel defining a pour panel such that when said scoreline is ruptured a pour opening is formed;

tab means attached to said center panel and including a lifting end and an opening end and operative in response to lifting of said lifting end to initiate and to continue rupture of said scoreline;

said panel radius being coined in a region less than 360° of the periphery thereof; and said region being operative to direct buckling, if it occurs, to a portion of the end structure other than in the region of said coined panel radius.

2. An end structure as set forth in claim 1 wherein said scoreline is discontinuous to provide a hinge through which said pour panel remains attached to said center panel subsequent to rupture of said scoreline;

said coined region of said panel radius being radially outwardly of said tab and said scoreline to protect said scoreline from rupture in the event of buckling.

3. An end structure as set forth in claim 1 wherein said panel radius coin region is on the public side of the said end structure.

4. An end structure as set forth in claim 1 wherein said panel radius coin region is on the non-public side of said end structure.

5. An end structure as set forth in claim 1 wherein said tab is affixed to said pour panel by an integral rivet;

said tab opening end being spaced from said rivet;

said scoreline including a portion between said rivet and the opening end of said tab; and said panel radius coin region being located radially outwardly of said rivet on the side thereof radially of said opening end of said tab.

6. An end structure as set forth in claim 1 wherein said pour panel and said tab are retained on said center panel after rupture of said scoreline.

7. An end structure as set forth in claim 6 wherein said tab functions as a Class 2 lever to initiate pop of said scoreline.

8. An end structure as set forth in claim 1 further including a coined region in said center panel section; and said center panel coined region being located radially outwardly of the opening end of said tab and radially inwardly of the panel radius.

9. An end structure for an easy-opening container comprising;

a center panel section having a scoreline terminating in reversing legs to form a pour panel which remains attached to said center panel upon rupture of said scoreline to form a pour opening;

a tab affixed to said pour panel by an integrally formed rivet, said tab including an opening end and a lifting end, means forming an opening in said tab to receive the user's finger to operate said tab in an opening sequence;

said scoreline including a portion extending between the opening end of said tab and the rivet;

said portion of said scoreline including a segment which has a residual less than the remainder of said scoreline;

said portion of said scoreline being of a configuration such that it changes direction on each side thereof forward of said rivet to reduce blow-off of said pour panel in response to pressure on the under side of said center panel; and said scoreline including corresponding regions in which the residual thereof increases from a minimum forward of said rivet to a maximum at said reversing legs.

10. An end structure as set forth in claim 9 further including a coined region in said center panel radially outwardly of said rivet to assist in maintaining the opening end of said tab against said center panel in response to pressure on the underside of said center panel.

11. An end wall for an easy opening container comprising;

a center panel having a scoreline defining an opening panel such that when said scoreline is ruptured an opening is formed in said center panel;

tab means attached to said opening panel, said tab including a lifting end and an opening end;

said tab including a finger opening therein to receive the user's finger in the normal operation of said tab in an opening sequence;

said tab being a longitudinally rigid tab being formed of multiple layers of sheet material and including an opening end formed of integral top, bottom and intermediate layers, the bottom layer being in contact with said center panel during a normal opening sequence; and the opening end of said tab being spaced from said rivet such that a portion of said scoreline extends between the rivet and the opening end of said tab.

12. An end wall as set forth in claim 11 wherein said scoreline includes spaced legs and is discontinuous to form a hinge spaced from the opening end of said tab.

13. An end wall as set forth in claim 12 wherein said tab functions as a Class 2 lever during the initial pop of said scoreline.

14. An end wall as set forth in claim 11 wherein said scoreline includes spaced legs and is discontinuous to form a hinge spaced from the opening end of said tab, and said tab operating upon lifting of the opening end to effect initial pop of a portion of said scoreline and upon pulling thereof to complete fracture of said scoreline to provide a retained strip, the exposed visible upper surface of which initially formed a portion of the lower surface of the end wall.

15. An end wall for an easy-opening container comprising:

a center panel section having a scoreline defining an opening panel such that when said scoreline is ruptured an opening is formed in said end wall;

tab means including a lifting end and an opening end affixed to said end wall by rivet means such that the opening end of said tab overlies a portion of said scoreline and is operative in response to lifting of said lifting end to initiate and to continue rupture of said scoreline;

said central panel including a peripheral region a portion of which extends radially outwardly of said rivet means and which is located beneath the opening end of said tab;

a coined region located in said portion of said central panel and extending circumferentially on each side of said rivet means, and said coined region cooperating with said tab to maintain said opening end of said tab closely adjacent to said central panel in response to pressure on the under side of said central panel.

16. An end wall for an easy-opening container comprising:

a center panel having a scoreline defining a pour panel such that when said scoreline is ruptured a pour opening is formed;

said scoreline being discontinuous to provide a hinge through which said panel remains attached to said central panel section subsequent to rupture of said scoreline, tab means including an opening end and a lifting end positioned in overlying relation to at least a portion of said scoreline such that the lifting end of said tab extends radially inwardly of said central panel;

rivet means securing said tab to said pour panel such that a portion of said scoreline extends between said rivet and said opening end of said tab;

said end panel including a peripheral portion which extends radially outwardly of said rivet to define the panel radius of said end panel; and a coined region in said peripheral portion and extending inwardly of said panel radius and toward said rivet and circumferentially on each side of said rivet and spaced therefrom.

17. An end wall as set forth in claim 16 further including a coined zone on said panel radius, said coined zone being located radially outwardly of said coined region and extending arcuately beyond said coined region.

18. An end wall for an easy-opening container as set forth in claim 15 wherein said coined region is radially outwardly of that portion of the scoreline located between said rivet and the opening end of said tab.

19. An end wall for an easy-opening container as set forth in claim 15 wherein the opening end of said tab overlies at least a portion of said coined region.

* * * * *